US007702426B2

(12) United States Patent
Ito et al.

(10) Patent No.: US 7,702,426 B2
(45) Date of Patent: Apr. 20, 2010

(54) REMOTE CONTROL SYSTEM FOR A BOAT

(75) Inventors: Makoto Ito, Shizuoka-ken (JP); Takashi Yamada, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 650 days.

(21) Appl. No.: 11/731,422

(22) Filed: Mar. 30, 2007

(65) Prior Publication Data

US 2007/0282490 A1 Dec. 6, 2007

(30) Foreign Application Priority Data

Jun. 5, 2006 (JP) ..... 2006-156526

(51) Int. Cl.
*F02D 29/00* (2006.01)
*B63H 21/22* (2006.01)
*G06F 19/00* (2006.01)

(52) U.S. Cl. ..... 701/2; 701/22; 440/87; 114/382

(58) Field of Classification Search ..... 701/2, 701/1, 22, 33, 36; 114/382; 440/87
See application file for complete search history.

(56) References Cited

U.S. PATENT DOCUMENTS

| | | | |
|---|---|---|---|
| 1,843,272 | A | 2/1932 | Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,622,938 | A | 11/1986 | Wenstadt et al. |
| 4,646,696 | A | 3/1987 | Dogadko |
| 4,648,697 | A | 3/1987 | Kawazoe |
| 4,747,381 | A | 5/1988 | Baltz et al. |

(Continued)

FOREIGN PATENT DOCUMENTS

| | | |
|---|---|---|
| JP | 03-061196 | 3/1991 |

(Continued)

OTHER PUBLICATIONS

Product catalog of i6000TEC—Triple Engine Electronic Shift & throttle of Teleflex Morse Co., Ltd. (USA).

(Continued)

*Primary Examiner*—Tan Q Nguyen
(74) *Attorney, Agent, or Firm*—Keating & Bennett, LLP

(57) ABSTRACT

There is provided a boat in which the units and control lines for effecting the switching processing of remote control units at the time of switching steering stations can be easily configured, and the system for effecting the switching processing can be easily simplified. A boat includes a first remote control unit connected to boat propulsion units, and a second remote control unit connected to the first remote control unit, the first and second remote control units including remote control levers for operating the boat propulsion units, and remote control selector switches. The first remote control unit has a switching determination section. The switching determination section performs switching processing between the first and second remote control units when the remote control levers of the first and second remote control units are both in the neutral state and the remote control selector switches are in the ON state.

16 Claims, 5 Drawing Sheets

U.S. PATENT DOCUMENTS

| | | | |
|---|---|---|---|
| 4,755,156 | A | 7/1988 | Wagner |
| 4,788,955 | A | 12/1988 | Wood |
| 4,801,282 | A | 1/1989 | Ogawa |
| 4,805,396 | A | 2/1989 | Veerhusen et al. |
| 4,809,506 | A | 3/1989 | Lauritsen |
| 4,810,216 | A | 3/1989 | Kawamura |
| 4,836,809 | A | 6/1989 | Pelligrino |
| 4,850,906 | A | 7/1989 | Kanno et al. |
| 4,858,585 | A | 8/1989 | Remmers |
| 4,898,045 | A | 2/1990 | Baba |
| 4,964,276 | A | 10/1990 | Sturdy |
| 5,004,962 | A | 4/1991 | Fonss et al. |
| 5,051,102 | A | 9/1991 | Onoue |
| 5,062,403 | A | 11/1991 | Breckenfeld et al. |
| 5,062,516 | A | 11/1991 | Prince |
| 5,065,723 | A | 11/1991 | Broughton et al. |
| 5,103,946 | A | 4/1992 | Masters et al. |
| 5,157,956 | A | 10/1992 | Isaji et al. |
| 5,167,212 | A | 12/1992 | Peter et al. |
| 5,273,016 | A | 12/1993 | Gillespie et al. |
| 5,318,466 | A | 6/1994 | Nagafusa |
| 5,381,769 | A | 1/1995 | Nishigaki et al. |
| 5,492,493 | A | 2/1996 | Ohkita |
| 5,539,294 | A | 7/1996 | Kobayashi |
| 5,595,159 | A | 1/1997 | Huber et al. |
| 5,664,542 | A | 9/1997 | Kanazawa et al. |
| 5,730,105 | A | 3/1998 | McGinnity |
| 5,749,343 | A | 5/1998 | Nichols et al. |
| 5,771,860 | A | 6/1998 | Bernardi |
| 5,782,659 | A | 7/1998 | Motose |
| 5,899,191 | A | 5/1999 | Rabbit et al. |
| 6,015,319 | A | 1/2000 | Tanaka |
| 6,026,783 | A | 2/2000 | Nestvall et al. |
| 6,058,349 | A | 5/2000 | Kikori et al. |
| 6,073,509 | A | 6/2000 | Salecker et al. |
| 6,073,592 | A | 6/2000 | Brown et al. |
| 6,095,488 | A | 8/2000 | Semeyn, Jr. et al. |
| 6,098,591 | A | 8/2000 | Iwata |
| 6,109,986 | A | 8/2000 | Gaynor et al. |
| 6,233,943 | B1 | 5/2001 | Beacom et al. |
| 6,273,771 | B1 | 8/2001 | Buckley et al. |
| 6,280,269 | B1 | 8/2001 | Gaynor |
| 6,351,704 | B1 | 2/2002 | Koerner |
| 6,379,114 | B1 | 4/2002 | Schott et al. |
| 6,382,122 | B1 | 5/2002 | Gaynor et al. |
| 6,414,607 | B1 | 7/2002 | Gonring et al. |
| 6,587,765 | B1 | 7/2003 | Graham et al. |
| 6,612,882 | B2 | 9/2003 | Shidara et al. |
| 6,704,643 | B1 | 3/2004 | Suhre et al. |
| 6,751,533 | B2 | 6/2004 | Graham et al. |
| 6,910,927 | B2 | 6/2005 | Kanno |
| 6,965,817 | B2 | 11/2005 | Graham et al. |
| 7,121,908 | B2 | 10/2006 | Okuyama |
| 7,142,955 | B1 | 11/2006 | Kern et al. |
| 7,153,174 | B2 | 12/2006 | Takeda et al. |
| 7,220,153 | B2 | 5/2007 | Okuyama |
| 2003/0082962 | A1 | 5/2003 | Kanno |
| 2003/0092331 | A1 | 5/2003 | Okuyama |
| 2003/0093196 | A1 | 5/2003 | Okuyama |
| 2004/0029461 | A1 | 2/2004 | Shomura |
| 2005/0118895 | A1 | 6/2005 | Kanno et al. |
| 2005/0245145 | A1 | 11/2005 | Takada et al. |
| 2005/0286539 | A1 | 12/2005 | Okuyama |
| 2006/0054067 | A1* | 3/2006 | Hoberman et al. ..... 114/145 R |
| 2006/0240720 | A1 | 10/2006 | Yamashita et al. |
| 2007/0017426 | A1* | 1/2007 | Kaji et al. ..... 114/144 RE |
| 2007/0082565 | A1 | 4/2007 | Okuyama |
| 2007/0082566 | A1 | 4/2007 | Okuyama |
| 2007/0178780 | A1 | 8/2007 | Ito et al. |
| 2007/0218785 | A1 | 9/2007 | Okuyama et al. |
| 2007/0232162 | A1 | 10/2007 | Okuyama et al. |

FOREIGN PATENT DOCUMENTS

| | | |
|---|---|---|
| JP | 2001-260986 | 9/2001 |
| JP | 2003-098044 | 4/2003 |
| JP | 2003-127986 | 5/2003 |
| JP | 2003-146293 | 5/2003 |
| JP | 2004-068704 | 3/2004 |
| JP | 2004-208452 | 7/2004 |
| JP | 2004-244003 | 9/2004 |
| JP | 2005-272352 | 9/2005 |
| JP | 2005-297785 | 10/2005 |
| JP | 2006-068575 | 3/2006 |
| JP | 2006-074794 | 3/2006 |
| JP | 2006-076871 | 3/2006 |
| JP | 2006-087325 | 4/2006 |
| JP | 2006-115305 | 4/2006 |
| JP | 2006-118039 | 5/2006 |
| JP | 2006-154480 | 6/2006 |
| JP | 2006-156526 | 6/2006 |
| WO | WO 2005-102833 | 11/2005 |

OTHER PUBLICATIONS

U.S. Appl. No. 11/688,818, filed Mar. 20, 2007, entitled Remote Control Device and Watercraft.

Barron, Jim. "Get on the Bus." Trailer Boats Magazine, Jun. 2000, p. 36.

Spisak, Larry. "Know it by Chart." Boating Magazine, May 2000, p. 100.

J.D. "Gains in technology will alter makeup of the . . . " Boating Industry International, Nov. 2000.

Declaration of Daniel J. Carr.

Denn, James. "Future boats sales will hinge on technology." Boating Industry International, Nov. 2000.

Hemmel, Jeff. "Information, Please—The digital boating revolution begins." Boating Magazine, Sep. 2000.

Kelly, Chris. "Can We Talk?" Power & Motoryacht Magazine, Jun. 2000, pp. 36 & 38, 39.

"Plug and Play" Advertisement from "Motorboating", Dec. 2000, p. 57.

"MagicBus™ i3000 Series Intelligent Steering" Instruction Manual. Telefex, Inc.

* cited by examiner

[FIG. 1]
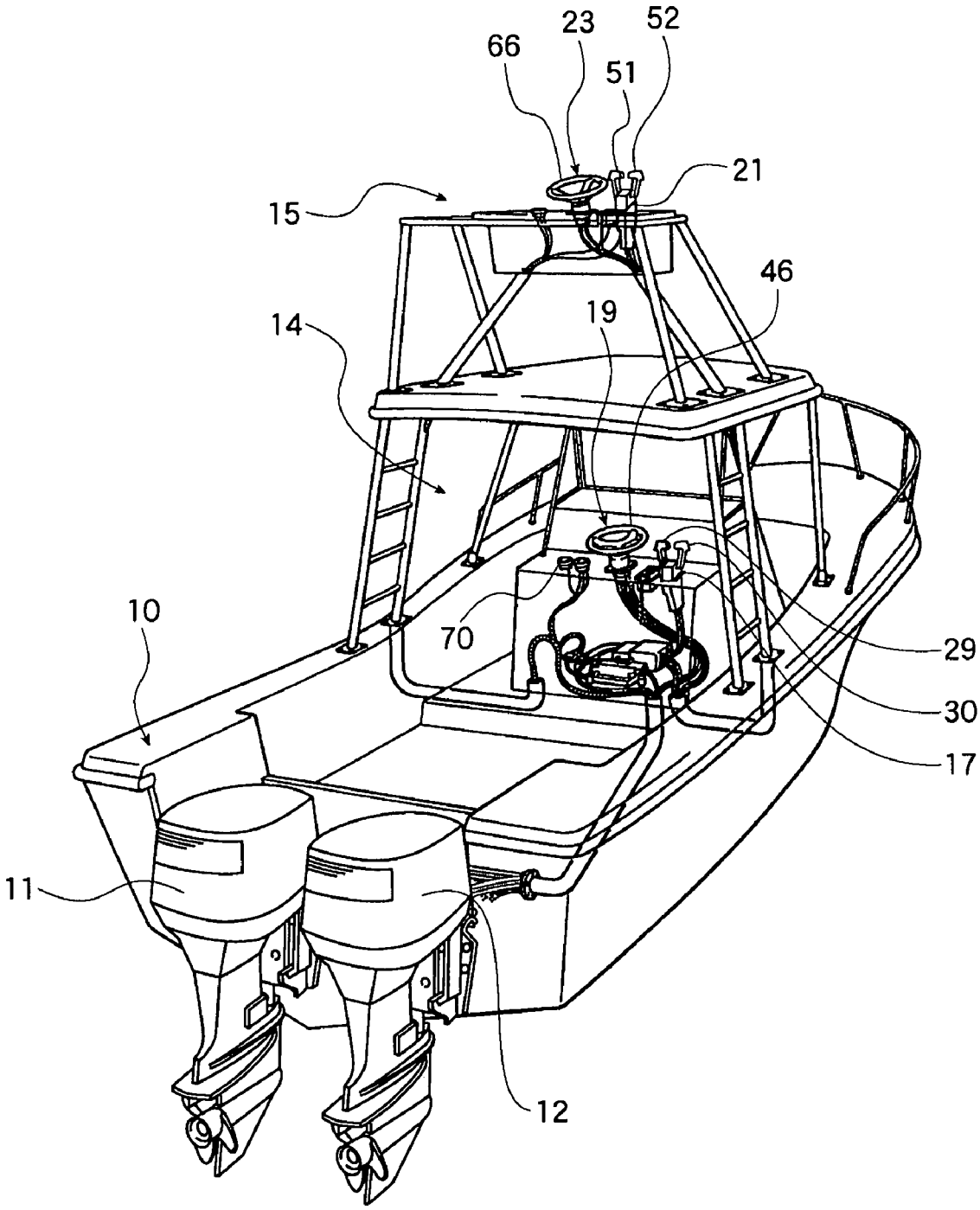

[FIG. 2]
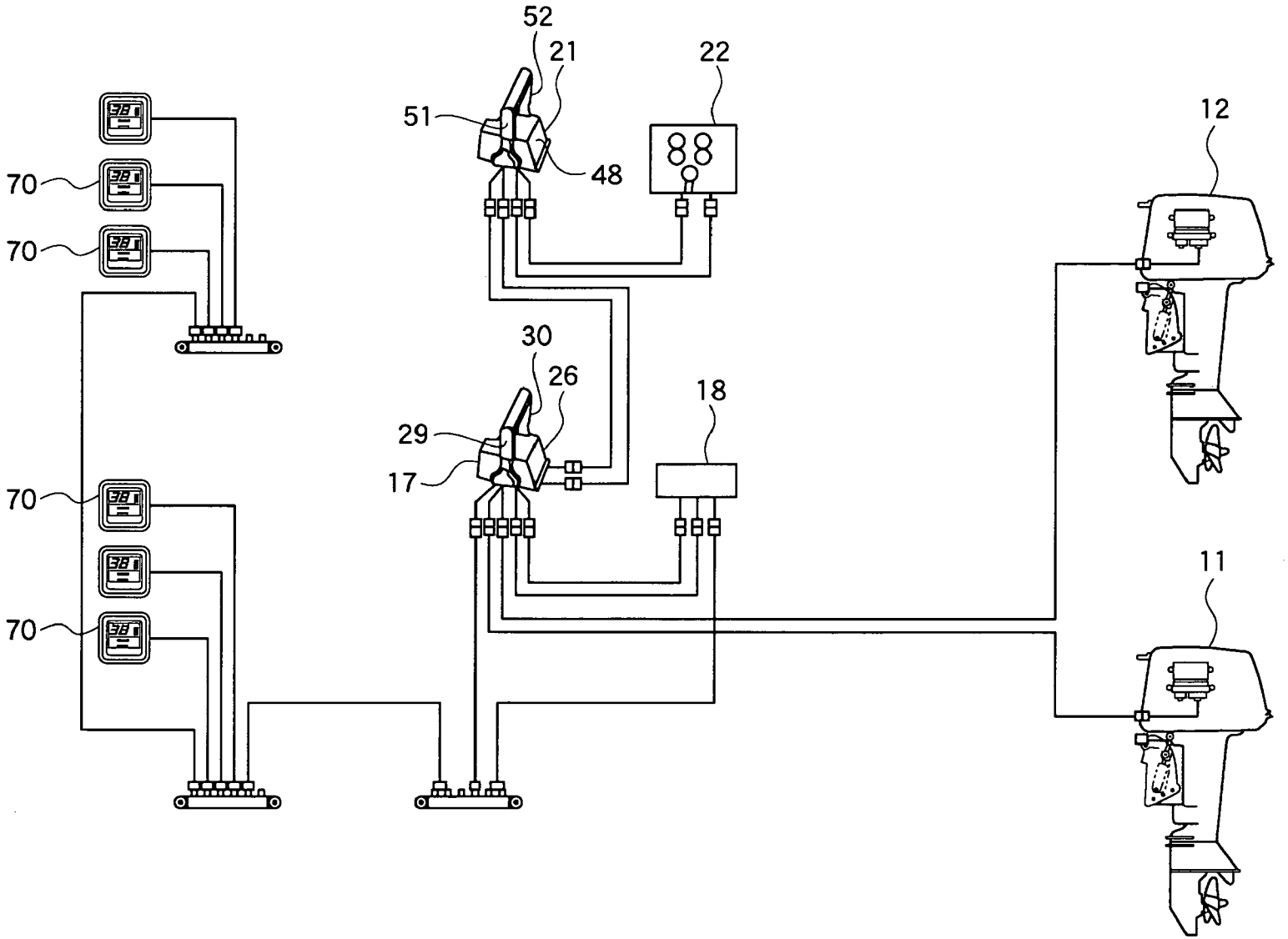

[FIG. 3]
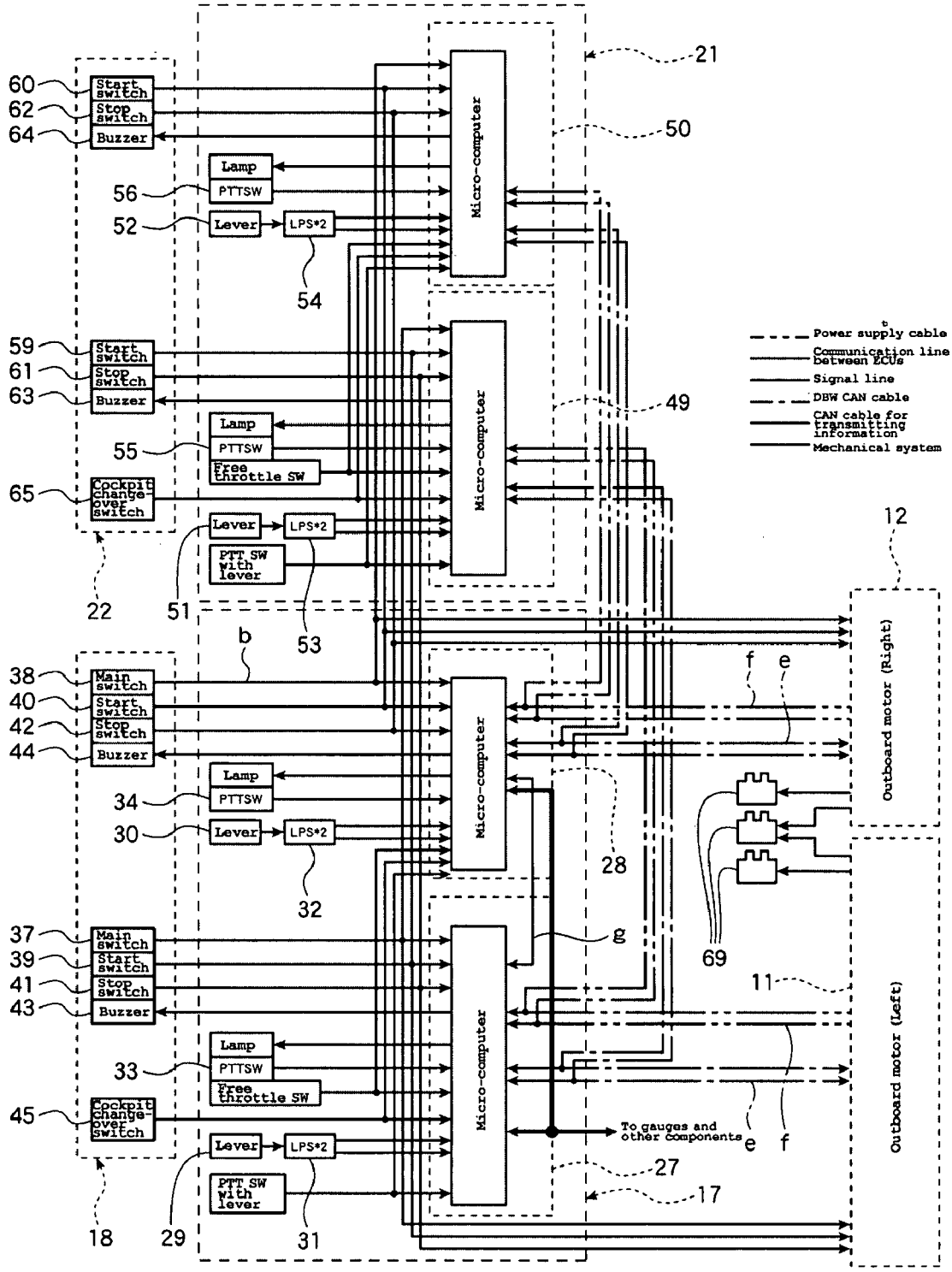

[FIG. 4]
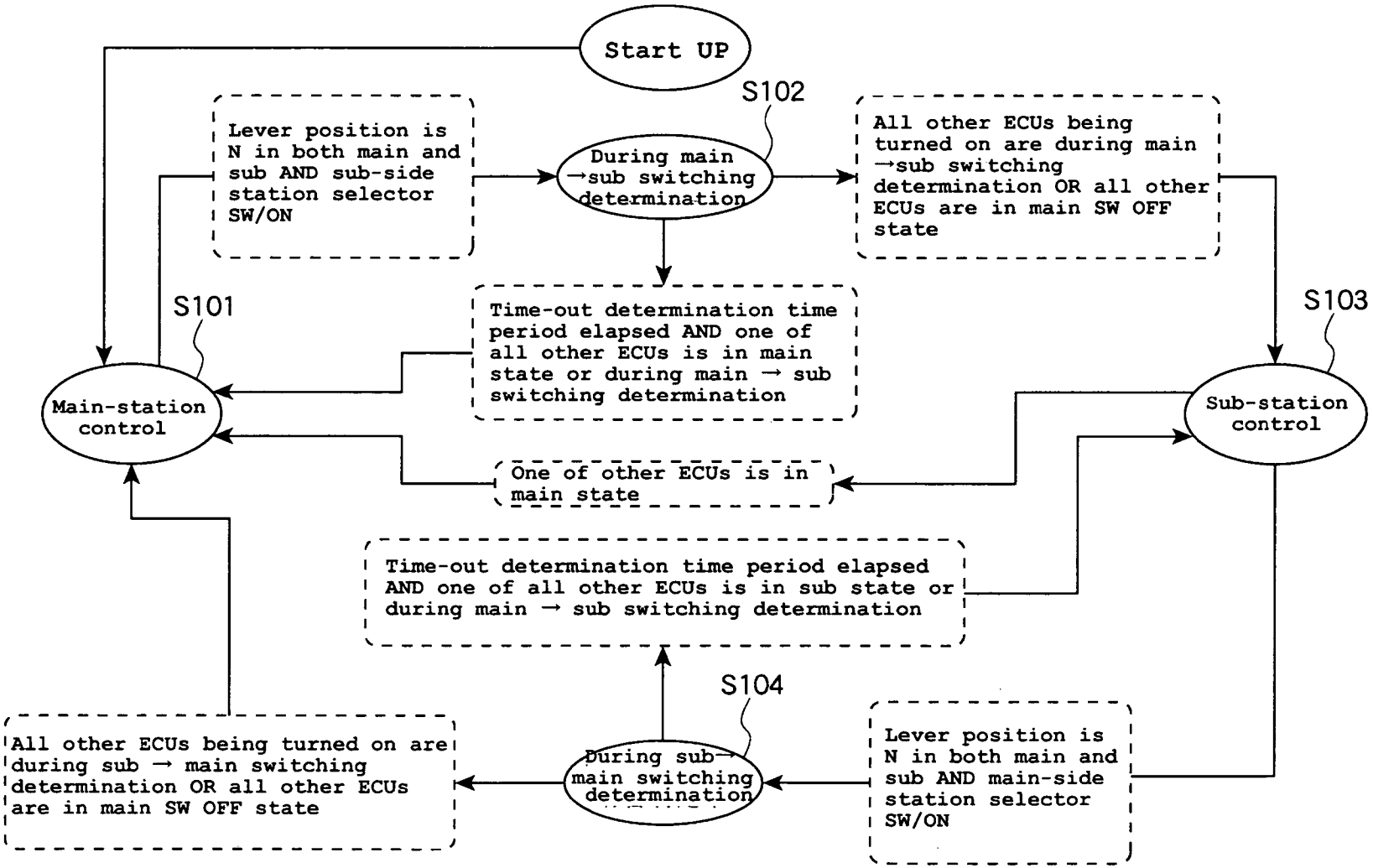

[FIG. 5]
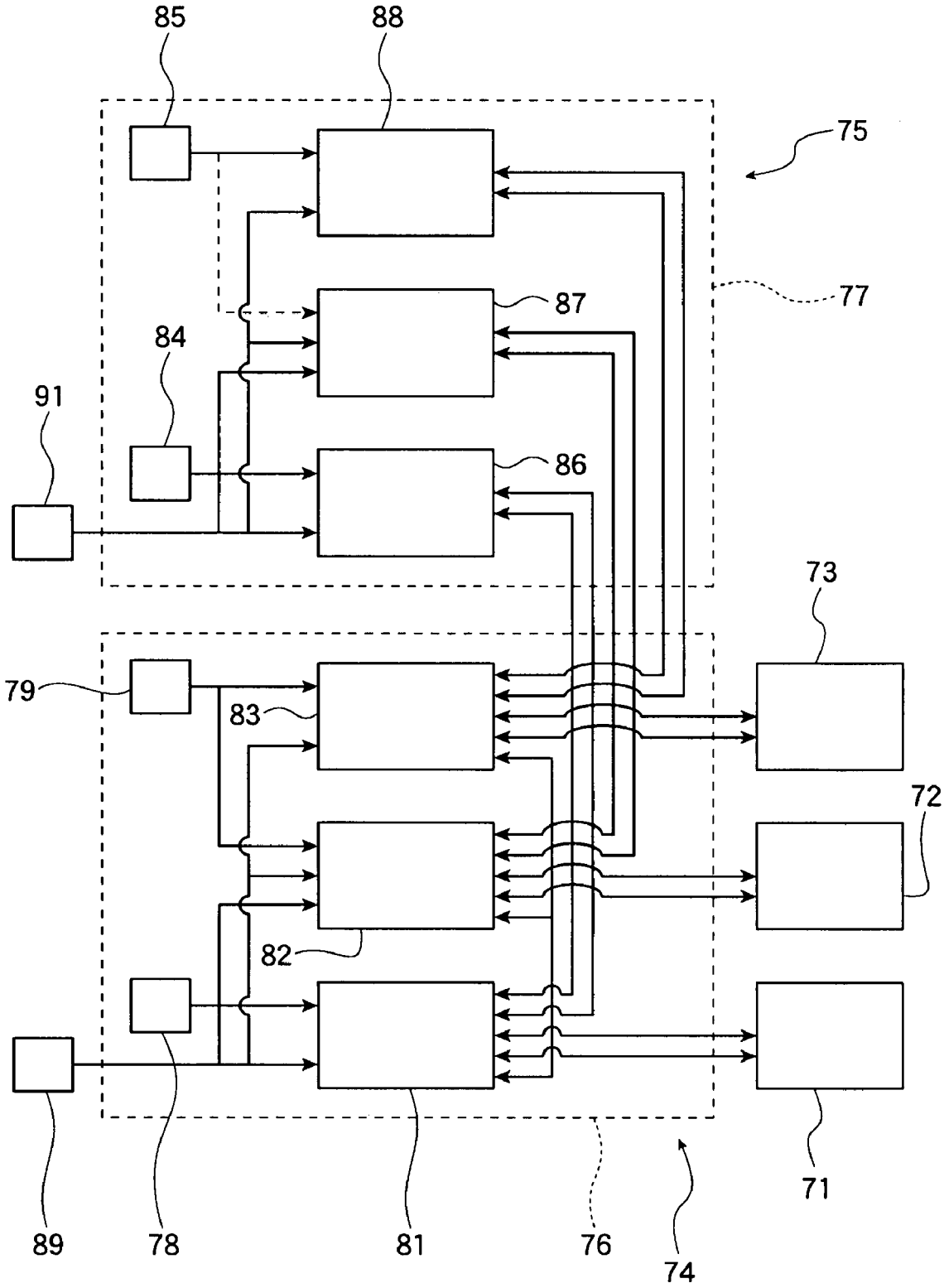

REMOTE CONTROL SYSTEM FOR A BOAT

CROSS-REFERENCE TO RELATED APPLICATIONS

The present application is based on and claims priority under 35 U.S.C. §119 to Japanese Patent Application Serial No. 2006-156526, filed on Jun. 5, 2006, the entire contents of which are expressly incorporated by reference herein.

BACKGROUND

1. Field

The present invention relates to a boat having a remote control system for controlling a propulsion unit of the boat, and more particularly to a boat having a plurality of remote control units.

2. Description of the Related Art

There are known boats in which a boat propulsion unit such as an outboard motor as is arranged in the stern of the hull, a main remote control station is disposed at the center of the hull, and a sub remote control station is disposed above the main station. In such a boat, an operating lever for operating the outboard motor is provided in each of the remote control stations, so a single outboard motor or each of a plurality of the outboard motors can be operated with the lever of each of the stations.

When the operating levers and the outboard motors are mechanically coupled to each other such as by a wire or the like, operating the lever of one steering station causes the lever of the other station to move in the same way and to assume basically the same operating position. Thus, the operation states of a plurality of levers for operating the same outboard motor can be made the same at all times.

In a boat using a remote control unit adapted to transmit the operation amount of the lever as an operation signal to the control section of the outboard motor, however, since the remote control levers for operating the same outboard motor are not mechanically coupled, they can be operated independently from each other. As such, a situation can arise in which the operation amount of one remote control lever differs from the operation amount of the other remote control lever.

Upon switching the control station in this state, the operation signal inputted to the outboard motor can change abruptly, thus causing a corresponding abrupt change in operation of the outboard motor. Accordingly, proposals have been made for preventing the operation signal inputted to the outboard motor from changing abruptly at the time of switching the steering stations. Such an example is disclosed in Japanese Patent document JP-B-3019984.

SUMMARY

Accordingly, there is a need in the art for a boat in which there are a plurality of remote control units, and switching to a single working remote control unit among the remote control units without an abrupt control signal change during the switching of the working remote control unit.

In accordance with one embodiment, a boat is provided that has a first remote control unit connected to a boat propulsion unit and a second remote control unit connected to the first remote control unit. Each of the first and second remote control units has a remote control lever configured to operate the boat propulsion unit and a remote control selector switch configured to select one of the remote control units as a working remote control unit. The first remote control unit has a switching determination section, and the switching determination section performs switching processing between the first and second remote control units when the remote control levers of the first and second remote control units are both in a neutral state and the remote control selector switch is in an ON state.

In accordance with one embodiment, each of the first and second remote control units has an engine control unit (ECU). Each of the engine control units has a microcomputer. At least one of the microcomputers has the switching determination section. Each of the microcomputers has the switching determination section.

In accordance with one embodiment, the second remote control unit is connected to the first remote control unit by a network.

In accordance with one embodiment, each of the first and second remote control units has a plurality of the remote control levers configured to operate a plurality of the boat propulsion units, and a plurality of the switching determination sections, any two of the plurality of switching determination sections being connected to each other by a communication line. Each of the switching determination sections becomes a determination state when the remote control levers of the first and second remote control units for operating the same boat propulsion unit are both in the neutral state and the remote control selector switch is in the ON state. The switching processing of the working remote control unit between the first and second remote control units occurs when the first and second remote control units are in the determination states. In the determination state, when information indicating that all the other remote control levers of the first and second remote control units are in the neutral state is transmitted via the communication line, the switching processing is performed with respect to the remote control lever corresponding to the switching determination section.

In accordance with one embodiment, each of the plurality of boat propulsion units has a main switch, and wherein the switching processing is performed by the switching determination section corresponding to the boat propulsion unit the main switch of which is in the ON state. A determination time period during which the determination state is maintained is set for each of the switching determination sections. The switching processing is not performed when information indicating that all the other remote control levers are in the neutral state is not transmitted within the determination time period.

In accordance with one embodiment, a determination time period during which the determination state is maintained is set for each of the switching determination sections. The switching processing is not performed when information indicating that all the other remote control levers are in the neutral state is not transmitted within the determination time period. When at least one of the switching determination sections selects the first remote control unit after the switching processing is performed, each of the other switching determination sections is forcibly switched to the first remote control unit.

BRIEF DESCRIPTION OF THE DRAWINGS

FIG. 1 is a perspective view of a boat according to one embodiment of the present invention, as seen diagonally from the rear.

FIG. 2 is a schematic diagram showing how remote control units, outboard motors, and the like are connected in the boat according to one embodiment.

FIG. 3 is a block diagram showing how the remote control units, key switches, outboard motors, and the like are connected in the boat according to one embodiment.

FIG. 4 is a system diagram showing the flow of switching processing performed in a switching determination section of the boat according to one embodiment.

FIG. 5 is a schematic diagram showing how remote control units, outboard motors, and the like are connected in a boat according to another embodiment of the present invention.

DETAILED DESCRIPTION OF EMBODIMENTS

FIGS. 1 to 4 show a boat according to an embodiment of the present invention.

First, the construction of the illustrated boat will be described. As shown in FIGS. 1 and 2, in the boat according to this embodiment, two outboard motors 11, 12 each serving as a "boat propulsion unit" are attached to the stern of a hull 10. The hull 10 is provided with two steering seats formed by a main station 14 as a "first station" and a sub station 15 as a "second station". A main-side remote control unit 17 as a "first remote control unit", a key switch unit 18, a steering wheel unit 19, and the like are arranged in the main station 14. A sub-side remote control unit 21 as a "second remote control unit", a key switch unit 22, a steering wheel unit 23, and the like are arranged in the sub station 15.

As shown in FIG. 3, in the main-side remote control unit 17 of the main station 14, preferably a left main-remote-control-side engine control unit (ECU) 27 for the outboard motor 11 on the left side, and a right main-remote-control-side ECU 28 for the outboard motor 12 on the right side are built in a remote control body 26. Also, a pair of remote control levers 29, 30 for effecting throttle/shift operation preferably are provided in correspondence with the respective outboard motors 11, 12. There are provided position sensors 31, 32 for detecting the respective positions of the remote control levers 29, 30, and the position sensors 31, 32 are connected to the main-remote-control-side ECUs 27, 28, respectively, each via two signal circuits b. The signal circuit b can comprise a plurality of conductive wires.

Each of the left main-remote-control-side ECU 27 and the right main-remote-control-side ECU 28 preferably incorporates a processing step for alternatively switching between the main-side remote control unit 17 and the sub-side remote control unit 21. Each of the main-remote-control-side ECUs 27, 28 includes a "switching determination section" to process that step.

Further, power trim and tilt (PTT) switches 33, 34 preferably are connected to the main-remote-control-side ECUs 27, 28, respectively, each via a signal circuit.

The key switch unit 18 is connected to each of the left and right main-remote-control-side ECUs 27, 28. The key switch unit 18 has main switches 37, 38, start switches 39, 40, stop switches 41, 42, and buzzers 43, 44 provided in correspondence with the respective main-remote-control-side ECUs 27, 28. Further, the key switch 18 is provided with a main station selector switch 45 as a "remote control selector switch" formed by a push button or the like that is operated to select the main-side remote control unit 17 as the effective controller for the outboard motors 11, 12. These components are connected to the main-remote-control-side ECUs 27, 28 via the signal circuits b.

The steering wheel unit 19 of the main station 14 is provided with a steering wheel 46 for performing steering. Although not shown, the rotation position (rotation angle position) of the steering wheel 46 is detected by a position sensor, and transmitted to a built-in steering-wheel-side ECU.

Further, this steering-wheel-side ECU is connected to each of the main-remote-control-side ECUs 27, 28 via a DBW CAN cable as a signal line. Here, DBW is an abbreviation for Drive-By-Wire and refers to a steering unit in which electrical connection is used instead of mechanical connection. Further, CAN is an abbreviation for Controller Area Network.

On the sub-side remote control unit 21 of the sub station 15, preferably a left main-remote-control-side ECU 49 for controlling the outboard motor 11 on the left side, and a right main-remote-control-side ECU 50 for controlling the outboard motor 12 on the right side are built in a remote control body 48. Also, there preferably are provided a pair of remote control levers 51, 52 respectively corresponding to the remote control levers 29, 30 of the main-side remote control unit 17 of the main station 14. There are provided position sensors 53, 54 for detecting the respective positions of the remote control levers 53, 54, and the position sensors 53, 54 are connected to the sub-remote-control-side ECUs 49, 50, respectively, each via two signal circuits b.

The left sub-remote-control-side ECU 49 and the right sub-remote-control-side ECU 50 preferably are adapted to transmit detection signals from the position sensors 53, 54 exclusively to the left main-remote-control-side ECU 27 and right main-remote-control-side ECU 28 of the main-side remote control unit 17, respectively. The left sub-remote-control-side ECU 49 and the right sub-remote-control-side ECU 50 do not have the "switching determination section" as described above.

Further, PTT switches 55, 56 preferably are connected to the sub-remote-control-side ECUs 49, 50, respectively, each via a signal circuit.

The key switch unit 22 preferably is connected to each of the left and right sub-remote-control-side ECUs 49, 50. The key switch unit 22 has start switches 59, 60, stop switches 61, 62, and buzzers 63, 64 provided in correspondence with the respective sub-remote-control-side ECUs 49, 50. Further, the key switch 22 preferably is provided with a sub station selector switch 65 as a "remote control selector switch" formed by a push button or the like that is operated to select the sub-side remote control unit 21 as the effective controller for the outboard motors 11, 12. These components are connected to the sub-remote-control-side ECUs 49, 50 via the signal circuits b.

The steering wheel unit 23 of the sub station 15 preferably is provided with a steering wheel 66 for performing steering. Although not shown, the rotation position (rotation angle position) of the steering wheel 66 is detected by a position sensor, and transmitted to a built-in steering-wheel-side ECU.

Further, in the main-side and sub-side remote control units 17, 21, the two main-remote-control-side ECUs 27, 28 and the two sub-remote-control-side ECUs 49, 50 preferably are connected to each other. That is, the left sub-remote-control-side ECU 49 is connected to the left main-remote-control-side ECU 27 via power cables f and DBW CAN cables e, and the right sub-remote-control-side ECU 50 is connected to the right main-remote-control-side ECU 28 via the power cables f and the DBW CAN cables e. Further, the left main-remote-control-side ECU 27 and the right main-remote-control-side ECU 28 are connected to each other by an ECU-to-ECU communication line g. The communication line g can comprise a plurality of conductive wires.

The left main-remote-control-side ECU 27 is connected to the outboard motor 11 on the left side via the power cables f and the DBW CAN cables e. Further, the right main-remote-control-side ECU 28 is connected to the outboard motor 12 on the right side via the power cables f and the DBW CAN cables e. It should be noted that three batteries 69 are connected to the outboard motors 11, 12. However, other structure is possible. For example, there can be fewer or more batteries connected to the outboard motors 11, 12.

The outboard motors 11, 12 are controlled in fuel injection amount, injection timing, ignition timing, and the like preferably by means of control signals that are transmitted from the respective main-remote-control-side ECUs 27, 28 via the power cables f and the DBW CAN cables e, on the basis of the throttle opening from a throttle opening sensor, the engine speed from a crank angle sensor, and the detection values from other respective sensors installed to detect aspects of the boat which can used to affect or control the operation of the outboard motors 11, 12.

Various detection values (operation information) such as the throttle opening and the engine speed preferably are transmitted from the outboard motors 11, 12 to the respective main-remote-control-side ECUs 27, 28 via the DBW CAN cables e. Such operation information can be thus mutually transmitted and received between the two main-remote-control-side ECUs 27, 28 via the ECU-to-ECU communication line g.

In the switching determination section of each of the main-remote-control-side ECUs 27, 28, on the basis of the operation on one of the remote control levers 29, 30 of the main-side remote control unit 17 or one of the remote control levers 51, 52 of the sub-side remote control unit 21 alternatively selected by the switching processing, a control signal is transmitted to each of the outboard motors 11, 12 by using drive information from the respective outboard motors 11, 12 so that the engine speed difference falls within a target value, thereby controlling the fuel injection amount, injection timing, ignition timing, and the like of each of the outboard motors 11, 12.

In the illustrated boat, the switching determination section included in each of the main-remote-control-side ECUs 27, 28 is adapted so that the switching processing for alternatively switching between the main-side remote control unit 17 and the sub-side remote control unit 21 can be effected in accordance with the flow as described below.

As shown in FIG. 4, first, it is assumed that a main-station control state S101, in which the remote control levers 29, 30 of the main-side remote control unit 17 are operative in controlling the associated outboard motors 11, 12, for example, is entered upon start-up with the main switches 37, 38 of the key switch unit 18 turned ON.

To switch from the main station 14 to the sub station 15 in accordance with a preferred embodiment, the remote control levers 29, 30 of the main-side remote control unit 17 and the remote control levers 51, 52 of the sub-side remote control unit 21 are set to the neutral state and the sub station selector switch 65 of the sub station 15 is turned ON.

A determination state S102 is entered in the left main-remote-control-side ECU 27 when the following conditions are met: the left remote control lever 29 of the main-side remote control unit 17 is in the neutral state and the right remote control lever 51 of the sub-side remote control unit 21 is in the neutral state; and the sub station selector switch 65 is ON.

The determination state S102 is entered in the right main-remote-control-side ECU 28 when the following conditions are met: the right remote control lever 30 of the main-side remote control unit 17 is in the neutral state and the right remote control lever 52 of the sub-side remote control unit 21 is in the neutral state; and the sub station selector switch 65 is ON.

With regard to the determination state S102, in each of the main-remote-control-side ECUs 27, 28, a determination time period during which this determination state S102 is maintained is set in advance. Within the determination time period, a determination is made with respect to information transmitted from the other of the main-remote-control-side ECUs 27, 28 via ECU-to-ECU communication.

Since the main switches 37, 38 corresponding to the respective main-remote-control-side ECUs 27, 28 are ON, in the left main-remote-control-side ECU 27, when switching capability information indicating that the right remote control lever 30 of the main-side remote control unit 17 and the right remote control lever 52 of the sub-side remote control unit 21 are in the neutral state is transmitted from the right main-remote-control-side ECU 28 within the determination time period, that is, when the right main-remote-control-side ECU 28 is in the determination state S102, preferably switching processing from the main-side remote control unit 17 to the sub-side remote control unit 21 is performed, so that the state transfers to a sub-station control state S103 in which the left remote control lever 51 of the sub-side remote control unit 21 becomes operative.

Further, in the right main-remote-control-side ECU 28, when switching capability information indicating that the left remote control lever 29 of the main-side remote control unit 17 and the left remote control lever 51 of the sub-side remote control unit 21 are in the neutral state is transmitted from the left main-remote-control-side ECU 27 within the determination time period, that is, when the left main-remote-control-side ECU 27 is in the determination state S102, switching processing from the main-side remote control unit 17 to the sub-side remote control unit 21 preferably is performed, so that the state moves to the sub-station control state S103 in which the left remote control lever 52 of the sub-side remote control unit 21 becomes operative in controlling the right side ECU.

It should be noted that when either one of the main switches 37, 38 is OFF, there is no information to be transmitted via ECU-to-ECU communication, and the process directly advances to the switching processing from the main-side remote control unit 17 to the sub-side remote control unit 21. Further, in this embodiment, when the other of the main-remote-control-side ECUs 27, 28 is already in the sub-station control state S103, the switching processing from the main-side remote control unit 17 to the sub-side remote control unit 21 is performed.

However, in the determination state S102, when both the main switches 37, 38 are ON and switching capability information is not transmitted to one of the main-remote-control-side ECUs 27, 28 within the determination time period, that is, in this embodiment, when switching capability information is not transmitted and the other of the main-remote-control-side ECUs 27, 28 is in the main-station control state S101, or when the other of the main-remote-control-side ECUs 27, 28 is in a switching determination state S104 that will be described later, preferably the switching processing from the main-side remote control unit 17 to the sub-side remote control unit 21 is not performed, and the process returns to the main-station control state S101.

In the determination processing as described above, in the event of a special circumstance where, although both the left main-remote-control-side ECU 27 and the right main-remote-control-side ECU 28 are in the determination state S102, switching capability information of one of the main-remote-control-side ECUs 27, 28 is not transmitted to the other due to, for example, a delay in the ECU-to-ECU communication, there can be cases where switching processing to different station control states S101, S103 is performed between the two main-remote-control-side ECUs 27, 28.

Accordingly, in this embodiment, when, immediately after switching processing to the sub-station control state S103 is performed in one of the main-remote-control-side ECUs 27, 28, the other is in the main-station control state S101, switching processing from the sub-station control state S103 to the main-station control state S101 is forcibly performed.

With the above-mentioned operations, the switching processing of the respective main-remote-control-side ECUs 27, 28 when switching from the main station 14 to the sub station 15 is completed.

When switching from the sub station 15 to the main station 14, the remote control levers 51, 52 of the sub-side remote control unit 21 and the remote control levers 29, 30 of the main-side remote control unit 17 are brought into the neutral state and the main station selector switch 45 is turned ON.

Then, in the left main-remote-control-side ECU 27, the determination state S104 is entered when the following conditions are met: the left remote control lever 51 of the sub-side remote control unit 21 is in the neutral state and the left remote control lever 29 of the main-side remote control unit 17 is in the neutral state; and the main station selector switch 45 is ON.

Further, in the right main-remote-control-side ECU 28, the determination state S104 is entered when the following conditions are met: the right remote control lever 52 of the sub-side remote control unit 21 is in the neutral state and the right remote control lever 30 of the main-side remote control unit 17 is in the neutral state; and the sub station selector switch 45 is ON.

With regard to the determination state S104, in each of the main-remote-control-side ECUs 27, 28, a determination time period during which this determination state S104 is maintained preferably is set in advance. Within the determination time period, a determination is made with respect to information transmitted from the other of the main-remote-control-side ECUs 27, 28 via ECU-to-ECU communication.

Since the main switches 37, 38 corresponding to the respective main-remote-control-side ECUs 27, 28 are ON, in the left main-remote-control-side ECU 27, when switching capability information indicating that the right remote control lever 52 of the sub-side remote control unit 21 and the right remote control lever 30 of the main-side remote control unit 17 are in the neutral state is transmitted from the right main-remote-control-side ECU 28 within the determination time period, that is, when the right main-remote-control-side ECU 28 is in the determination state S104, switching processing from the sub-side remote control unit 21 to the main-side remote control unit 17 is performed, so that the state transfers to the main-station control state S101 in which the left remote control lever 29 of the main-side remote control unit 17 becomes operative.

Further, in the right main-remote-control-side ECU 28, when switching capability information indicating that the left remote control lever 51 of the sub-side remote control unit 21 and the left remote control lever 29 of the main-side remote control unit 17 are in the neutral state is transmitted from the left main-remote-control-side ECU 27 within the determination time period, that is, when the left main-remote-control-side ECU 27 is in the determination state S104, switching processing from the sub-side remote control unit 21 to the main-side remote control unit 17 is performed, so that the state transfers to the main-station control state S101 in which the left remote control lever 23 of the main-side remote control unit 17 becomes operative.

It should be noted that when either one of the main switches 37, 38 is OFF, there is no information to be transmitted via ECU-to-ECU communication, and the process directly advances to the switching processing from the sub-side remote control unit 21 to the main-side remote control unit 17. Further, in this embodiment, when the other of main-remote-control-side ECUs 27, 28 is already in the main-station control state S101, the switching processing from the sub-side remote control unit 21 to the main-side remote control unit 17 is performed.

In the determination state S102, when both the main switches 37, 38 are ON and switching capability information is not transmitted to one of the main-remote-control-side ECUs 27, 28 within the determination time period, that is, in this embodiment, when switching capability information is not transmitted and the other of the main-remote-control-side ECUs 27, 28 is in the sub-station control state S103, or when the other of the main-remote-control-side ECUs 27, 28 is in the switching determination state S102 described above, the switching processing from the sub-side remote control unit 21 to the main-side remote control unit 17 is not performed, and the process returns to the sub-station control state S103.

In the determination processing as described above, in the event of a special circumstance where, although both the left main-remote-control-side ECU 27 and the right main-remote-control-side ECU 28 are in the determination state S104, switching capability information of one of the main-remote-control-side ECUs 27, 28 is not transmitted to the other due to, for example, a delay in the ECU-to-ECU communication, there can be cases where switching processing to different station control states S101, S103 is performed between the two main-remote-control-side ECUs 27, 28.

In such cases, immediately after switching processing to the sub-station control state S103 is performed in one of the main-remote-control-side ECUs 27, 28, since the other is in the main-station control state S101, switching processing from the sub-station control state S103 to the main-station control state S101 preferably is forcibly performed in the same manner as described above.

As such, with the above-mentioned operations, the switching processing of the respective main-remote-control-side ECUs 27, 28 when switching from the main station 14 to the sub station 15 is completed.

According to the boat as described above, since the switching determination sections included in the respective main-remote-control-side ECUs 27, 28 make a determination as to whether or not the respective remote control levers 29, 30, 50, 51 of both the remote control units 17, 21 are in the neutral state, there is no need to perform processing for detecting the operation amounts of the respective remote control levers 29, 30, 51, 52, thus the determination can be readily made.

Further, in the illustrated boat in which the sub-side remote control unit 21 is connected to the main-side remote control unit 17, and the main-side remote control unit 17 is connected to the outboard motors 11, 12 so that the operations on the remote control levers 51, 52 of the sub-side remote control unit 21 are transmitted to the main-side remote control unit 17, since the switching determination section is provided in each of the main-remote-control-side ECUs 27, 28 of the main-side remote control unit 17, the states of the remote control levers 51, 52 of the sub-side remote control unit 21 can be readily grasped on the side of the main-side remote control unit 17, and there is no need to perform switching processing in the sub-side remote control unit 21, thereby allowing respective units and control lines to be more easily and simply configured. As a result, it is possible to simplify the system for effecting switching processing.

Further, the switching determination section is provided in each of the plurality of main-remote-control-side ECUs 27, 28 corresponding to the plurality of outboard motors 11, 12, and switching processing is performed for each of the individual main-remote-control-side ECUs 27, 28. Accordingly, the respective units and control lines of the plurality of main-remote-control-side ECUs 27, 28 can be made of the same structure, thereby making it readily possible to achieve the commonality of parts.

Further, since the plurality of the main-remote-control-side ECUs 27, 28 are connected to each other by the ECU-to-ECU communication line g, and switching processing is performed in accordance with the states of all the other remote control levers 29, 30, 51, 52 in the determination states S102, S104, even when switching processing is performed for each of the plurality of individual main-remote-control-side ECUs 27, 28, it is easy to prevent a situation where switching processing performed with respect to the main-side remote control unit 17 and the sub-side remote control unit 21 differs between the left and right remote control levers 29, 30 and 51, 52.

Further, since switching processing is performed in the main-remote-control-side ECUs 27, 28 with respect to the outboard motors 11, 12 in the ON state, there is no need to perform switching processing with respect to the outboard motors 11, 12 since they are not being used. As such, the system is further simplified.

In one embodiment, when information indicating that all the other remote control levers 29, 30, 51, 52 are switchable is not transmitted via the ECU-to-ECU communication line g within the determination time period during which the determination state S102, S104 is maintained, it is assumed that the other remote control levers 29, 30, 51, 52 are not in the switchable state, and thus no switching processing is performed. Accordingly, there is no need to transmit information indicating the non-switchable state via the ECU-to-ECU communication line g, thereby making it possible to further simplify the system for effecting switching processing.

In other embodiments, when, after the switching processing, at least one of the main-remote-control-side ECUs 27, 28 selects the main-side remote control unit 17, switching to the main-side remote control unit 17 is forcibly performed. Accordingly, even when a situation arises in which different station control states S101, S103 are selected between the main-remote-control-side ECUs 27, 28 due to an abnormality such as a communication delay during the switching processing, the station control states can be forcibly made the same, thus making it easy to ensure safety.

FIG. 5 schematically illustrates the connection between remote control units and outboard motors in a boat according to the embodiment of the present invention. In the illustrated embodiment, the boat has three outboard motors 71, 72, 73. The outboard motors 71, 72, 73 can be operated with a main-side remote control unit 76 and a sub-side remote control unit 77, respectively, provided in a main station 74 and a sub station 75.

The main-side remote control unit 76 is provided with a pair of remote control levers 78, 79, and three main-remote-control-side ECUs 81, 82, 83 corresponding to the three outboard motors 71, 72, 73. A position sensor of the remote control lever 78 is connected to the main-remote-control-side ECUs 81, 82, and a position sensor of the other remote control lever 79 is connected to the main-remote-control-side ECUs 82, 83. The main-remote-control-side ECUs 81, 82, 83 are respectively connected to the corresponding outboard motors 71, 72, 73.

The sub-side remote control unit 77 preferably is provided with a pair of remote control levers 84, 85, and three sub-remote-control-side ECUs 86, 87, 88 corresponding to the three main-remote-control-side ECUs 81, 82, 83. A position sensor of the remote control lever 84 is connected to the sub-remote-control-side ECUs 86, 87, and a position sensor of the other remote control lever 85 is connected to the sub-remote-control-side ECUs 86, 87. Further, the sub-remote-control-side ECUs 86, 87, 88 are respectively connected to the corresponding main-remote-control-side ECUs 81, 82, 83. Operations on the pair of remote control levers 84, 85 are transmitted to the main-remote-control-side ECUs 81, 82, 83, thereby making it possible to control the three outboard motors 71, 72, 73.

Key switch units of the main station 74 and sub station 75 preferably are provided with a main station selector switch 89 and a sub station selector switch 91, respectively. The main station selector switch 89 and the sub station selector switch 91 are respectively connected to the main-remote-control-side ECUs 81, 82, 83 and the sub-remote-control-side ECUs 86, 87, 88.

Further, in this embodiment as well, the "switching determination section" is included in each of the main-remote-control-side ECUs 81, 82, 83, and the main-remote-control-side ECUs 81, 82, 83 are connected to each other by an ECU-to-ECU communication line to enable communication.

In the above-described boat, the switching determination sections included in the respective main-remote-control-side ECUs 81, 82, 83 make a determination as to whether or not the respective remote control levers 78, 79, 84, 85 of both the remote control units 76, 77 are in the neutral state. Accordingly, there is no need to perform processing for detecting the amounts of operation on the respective remote control levers 78, 79, 84, 85, in order to match such amounts. As such, the switching determination can be readily made.

Further, in the illustrated boat in which the sub-side remote control unit 77 is connected to the main-side remote control unit 76, and the main-side remote control unit 76 is connected to the outboard motors 71, 72, 73 so that the operations on the remote control levers 84, 85 of the sub-side remote control unit 77 are transmitted to the main-side remote control unit 76, since the switching determination section is provided in each of the main-remote-control-side ECUs 81, 82, 83 of the main-side remote control unit 76, the states of the remote control levers 84, 85 of the sub-side remote control unit 77 can be readily grasped on the side of the main-side remote control unit 76, and there is no need to perform switching processing in the sub-side remote control unit 77, thereby allowing respective units and control lines to be easily configured. As a result, it is possible to simplify the system for effecting switching processing.

In one embodiment, the switching determination section is provided in each of the plurality of main-remote-control-side ECUs 81, 82, 83 corresponding to the plurality of outboard motors 71, 72, 73, and switching processing is performed for each of the individual main-remote-control-side ECUs 81, 82, 83. Accordingly, the respective units and control lines of the plurality of main-remote-control-side ECUs 81, 82, 83 can have substantially the same structure, thereby making it easy to achieve the commonality of parts.

In yet another embodiment, since the plurality of the main-remote-control-side ECUs 81, 82, 83 are connected to each other by the ECU-to-ECU communication line, and switching processing is performed in accordance with the states of all the other remote control levers 78, 79, 84, 85 in the determination states S102, S104, even when switching processing is performed for each of the plurality of individual main-remote-control-side ECUs 81, 82, 83, it is easy to prevent a situation where switching processing performed with respect to the main-side remote control unit 76 and the sub-side remote control unit 77 differs between the left and right remote control levers 78, 79 and 84, 85.

Further, since switching processing is performed only in the main-remote-control-side ECUs 81, 82, 83 with respect to the outboard motors 71, 72, 73 in the ON state, there is no need to perform switching processing with respect to the outboard motors 71, 72, 73, which are not being used to effect or control switching, thereby making it possible to further simplify the system.

In some embodiments, when information indicating that all the other remote control levers 78, 79, 84, 85 are switchable is not transmitted via the ECU-to-ECU communication line within the determination time period during which the determination state S102, S104 is maintained, it is assumed that the other remote control levers 78, 79, 84, 85 are not in the switchable state, and thus no switching processing is performed. Accordingly, there is no need to transmit information indicating the non-switchable state via the ECU-to-ECU communication line, thereby making it possible to further simplify the system for effecting switching processing.

In other embodiments, when, after the switching processing, at least one of the main-remote-control-side ECUs 81, 82, 83 selects the main-side remote control unit 76, switching to the main-side remote control unit 76 is forcibly performed. Accordingly, even when a situation arises in which different station control states S101, S103 are selected between the main-remote-control-side ECUs 81, 82, 83 due to an abnormality such as a communication delay during the switching processing, the station control states can be forcibly made the same, thus making it easy to ensure safety.

Although this remote control system and apparatus has been disclosed in the context of certain preferred embodiments and examples, it will be understood by those skilled in the art that the present inventions extend beyond the specifically disclosed embodiments to other alternative embodiments and/or uses of the remote control system and obvious modifications and equivalents thereof. For example, the boat can have more than three outboard motors and corresponding number of ECUs and batteries. In addition, while a number of variations of the remote control apparatus have been shown and described in detail, other modifications, which are within the scope of this remote control system, will be readily apparent to those of skill in the art based upon this disclosure. It is also contemplated that various combinations or sub-combinations of the specific features and aspects of the embodiments may be made and still fall within the scope of the inventions. Accordingly, it should be understood that various features and aspects of the disclosed embodiments can be combined with or substituted for one another in order to form varying modes of the inventions. Thus, it is intended that the scope of the present inventions herein disclosed should not be limited by the particular disclosed embodiments described above, but should be determined only by a fair reading of the claims.

What is claimed is:

1. A boat comprising a first remote control unit connected to a boat propulsion unit, and a second remote control unit connected to the first remote control unit, each of the first and second remote control units comprising a remote control lever configured to operate the boat propulsion unit, and a remote control selector switch configured to select one of the first and second remote control units as a working remote control unit, wherein the first remote control unit has a switching determination section, and wherein the switching determination section performs switching processing between the first and second remote control units when the remote control levers of the first and second remote control units are in a neutral state and the remote control selector switch is in an ON state.

2. The boat according to claim 1, wherein each of the first and second remote control units comprises an engine control unit (ECU).

3. The boat according to claim 2, wherein each of the engine control units comprises a microcomputer.

4. The boat according to claim 3, wherein at least one of the microcomputers comprises the switching determination section.

5. The boat according to claim 1, wherein only the first remote control unit has the switching determination section.

6. The boat according to claim 1, wherein the second remote control unit is connected to the first remote control unit by a network.

7. The boat according to claim 6, wherein the second remote control unit communicates with the boat propulsion unit via the first remote control unit.

8. The boat according to claim 1, wherein each of the first and second remote control units each comprise a plurality of the remote control levers configured to operate a plurality of the boat propulsion units, and the first remote control unit comprises a plurality of the switching determination sections, any two of the plurality of switching determination sections being connected to each other by a communication line.

9. The boat according to claim 8, wherein each of the switching determination sections is adapted to switch control to the one of the first and second units having the remote control selector switch in an ON state when the determination section determines that the remote control levers of the first and second remote control units are in the neutral state.

10. The boat according to claim 9, wherein a determination time period is started upon placing of the remote control selector switch into the ON state.

11. The boat according to claim 10, wherein the switching processing is not performed when information indicating that all the other remote control levers are in the neutral state is not transmitted within the determination time period.

12. The boat according to claim 11, wherein each of the plurality of boat propulsion units comprises a main switch, and wherein the switching processing is performed by the switching determination section corresponding to the boat propulsion unit the main switch of which is in the ON state.

13. The boat according to claim 8, wherein a determination time period is started upon placing of the remote control selector switch into the ON state.

14. The boat according to claim 13, wherein the switching processing is not performed when information indicating that all the other remote control levers are in the neutral state is not transmitted within the determination time period.

15. The boat according to claim 13, wherein when at least one of the switching determination sections selects the first remote control unit after the switching processing is performed, each of the other switching determination sections is forcibly switched to the first remote control unit.

16. The boat according to claim 15, wherein each of the first and second remote control units comprises an engine control unit (ECU), wherein each of the engine control units comprises a microcomputer, wherein at least one of the microcomputers comprises the switching determination section.

* * * * *